United States Patent [19]

Wehrli, III et al.

[11] 4,034,856

[45] July 12, 1977

[54] ELEVATOR SYSTEM

[75] Inventors: Henry A. Wehrli, III; Franklin S. Malick, both of Monroeville, Pa.

[73] Assignee: Westinghouse Electric Corporation, Pittsburgh, Pa.

[21] Appl. No.: 640,302

[22] Filed: Dec. 12, 1975

[51] Int. Cl.[2] ..... B66B 1/32

[52] U.S. Cl. ..... 187/29 R

[58] Field of Search ..... 187/29

[56] References Cited

U.S. PATENT DOCUMENTS

| | | | |
|---|---|---|---|
| 3,516,518 | 6/1970 | Krauer et al. | 187/29 |
| 3,523,232 | 8/1970 | Hall et al. | 187/29 |
| 3,570,630 | 3/1971 | Voigt et al. | 187/29 |
| 3,773,146 | 11/1973 | Dixon, Jr. et al. | 187/29 |
| 3,948,357 | 4/1976 | Maynard et al. | 187/29 |

*Primary Examiner*—Robert K. Schaefer
*Assistant Examiner*—W. E. Duncanson, Jr.
*Attorney, Agent, or Firm*—D. R. Lackey

[57] ABSTRACT

An elevator system including an elevator car mounted for movement in a building to serve the floors therein. The deceleration control for stopping the elevator car accurately at a selected floor, regardless of load and direction of the elevator car, continuously adjusts the braking torque to provide the desired velocity versus time pattern, and the desired distance versus time pattern, wherein both the deceleration distance and the deceleration time are fixed quantities.

8 Claims, 5 Drawing Figures

ELEVATOR SYSTEM

BACKGROUND OF THE INVENTION

1. Field of the Invention

The invention relates in general to elevator systems, and more specifically to deceleration control for elevator systems of the traction type.

2. Description of the Prior Art

An elevator car must land smoothly and accurately, regardless of load and travel direction. This accuracy and smoothness is obtained by continuously controlling the deceleration torque. For example, it is common to use a direct current drive motor for driving the traction sheave, either directly or through a reduction gear, along with variable direct current voltage control which controls the magnitude and the polarity of the direct current voltage applied to the drive motor in response to some type of feedback arrangement. Direct current systems provide the desired smoothness and accuracy, and are almost universally used in gearless elevator systems which operate at contract speeds of about 500 FPM and higher.

Geared traction elevator systems conventionally use variable voltage direct current drive motors and control at the upper end of the geared speed range, such as about 200 to 500 FPM, and alternating current drive motors with rheostatic, or other suitable control, at the lower end of the speed range such as about 50 to 200 FPM. Alternating current drive systems are less costly than direct current drive systems, but in general are not as smooth and accurate. The economic advantage of an alternating current drive, however, is very attractive and many different arrangements have been used for improving the landing smoothness and accuracy of such systems, such as (a) using large flywheels with single or two-speed alternating current drive motors, (b) open loop control of a variable force friction brake with a fixed braking distance, or open loop control of braking distance with fixed braking force, with adjustments according to load, speed, load and speed, load and direction, speed and direction, or (c) closed loop control of a friction brake responsive to the error between a feedback signal responsive to actual car speed and a predetermined braking pattern of desired car speed at that particular point in time.

The above-mentioned arrangements have achieved various degrees of success, with the closed loop velocity controlled braking being the most accurate of the prior art systems, under all conditions of load, travel direction and car speed. It would be desirable to provide a new and improved closed loop controlled braking arrangement for elevator systems which is highly accurate, such as landing accuracies of ±0.25 inch, and with repeatable highly accurate landings under all conditions of load, speed and travel direction. Further, the new and improved system should provide a short floor-to-floor time without jolts, or other speed discontinuities which might cause passenger discomfort, and the system must be implemented with a low cost control package which includes an alternating current drive motor and reduction gear.

SUMMARY OF THE INVENTION

Briefly, the present invention is a new and improved elevator system which utilizes a controlled braking arrangement especially suitable for a geared alternating current traction drive elevator system. The new and improved braking arrangement provides smooth stops and excellent landing accuracy combined with short floor-to-floor times, enabling the system to be used at some contract speeds where variable voltage direct current geared systems are commonly used, with a substantial cost advantage.

More specifically, the present invention is an elevator system with a controlled friction brake, with the brake being controlled by a closed loop feedback control arrangement which independently controls car velocity and distance to floor level as a function of time. The deceleration time and deceleration distance are both constant values, which are preselected to provide a predetermined maximum deceleration rate. Thus, the car speed is the only variable to be controlled over the fixed deceleration path, and it is controlled by a first error signal responsive to the deviation of the actual speed of the elevator car from a predetermined speed versus time pattern, and according to a second error signal responsive to the deviation of the location of the elevator car in the deceleration path from the desired location of the car, with respect to time. This combination of speed and distance to floor level with respect to time control has been found to provide very smooth and accurate landings which bring the elevator car directly into floor level without delays which add to floor-to-floor time. In the preferred embodiment, the two error signals are arranged to add to or subtract from, as required, a predetermined constant value of braking voltage, with the magnitude of this braking voltage being that value which will cause the friction brake to stop the elevator car exactly at floor level when the elevator car and its load exactly balance the weight of the counterweight, without modification of this constant voltage by an error signal.

BRIEF DESCRIPTION OF THE DRAWINGS

The invention may be better understood, and further advantages and uses thereof more readily apparent, when considered in view of the following detailed description of exemplary embodiments, taken with the accompanying drawings, in which.

DESCRIPTION OF THE PREFERRED EMBODIMENTS

Figure 1:
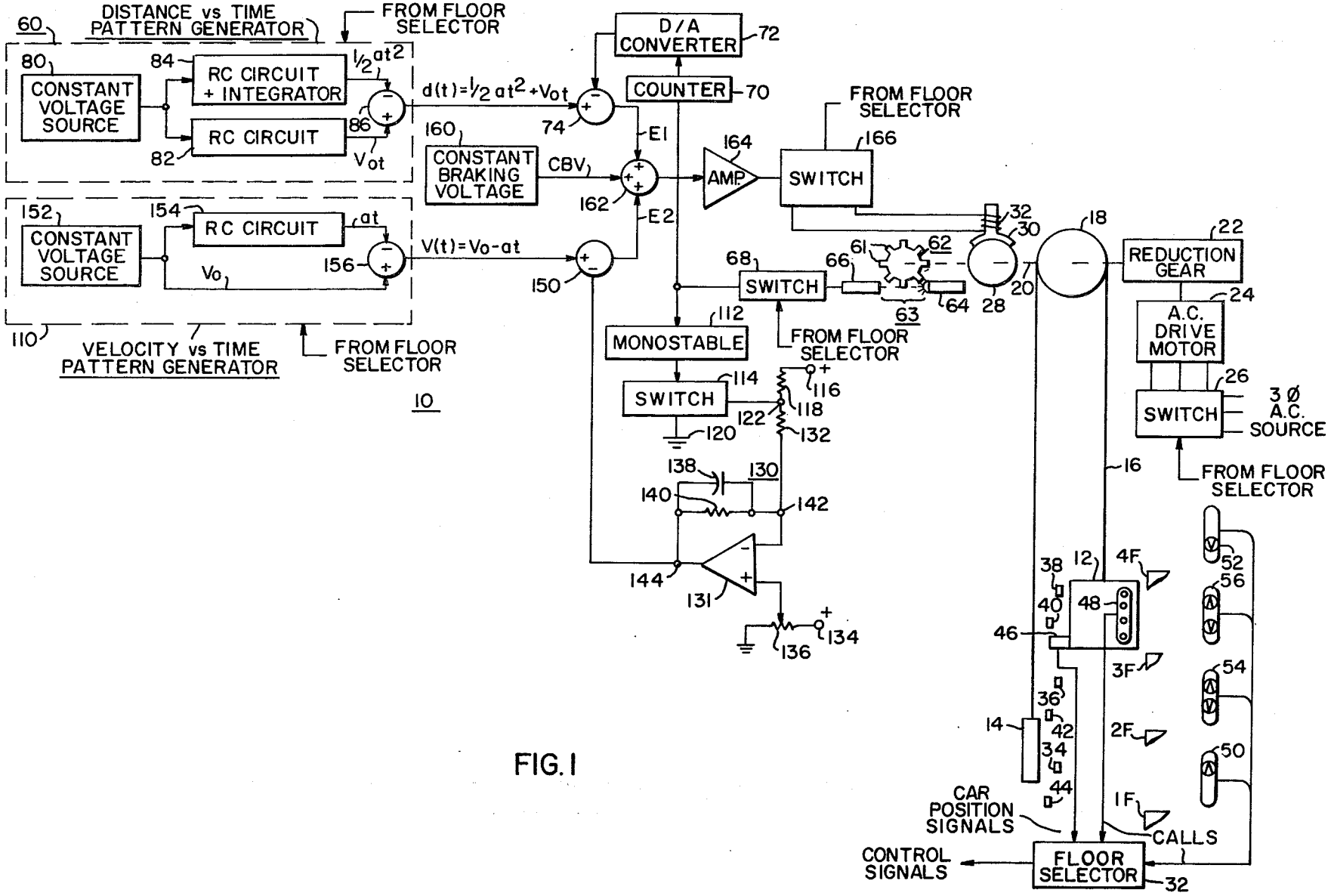
FIG. 1 is a schematic diagram of an elevator system constructed according to the teachings of the invention.

Referring now to the drawings, and to FIG. 1 in particular, there is shown a schematic diagram of an elevator system 10 constructed according to the teachings of the invention. While the new and improved elevator control may be applied to any type of elevator drive, and any type of control apparatus which provides a controlled deceleration torque in response to a control signal, it is particularly advantageous in geared elevator systems which utilize an alternating current drive motor, and which have a controllable friction brake, and the invention will be described in this context.

Figure 2:
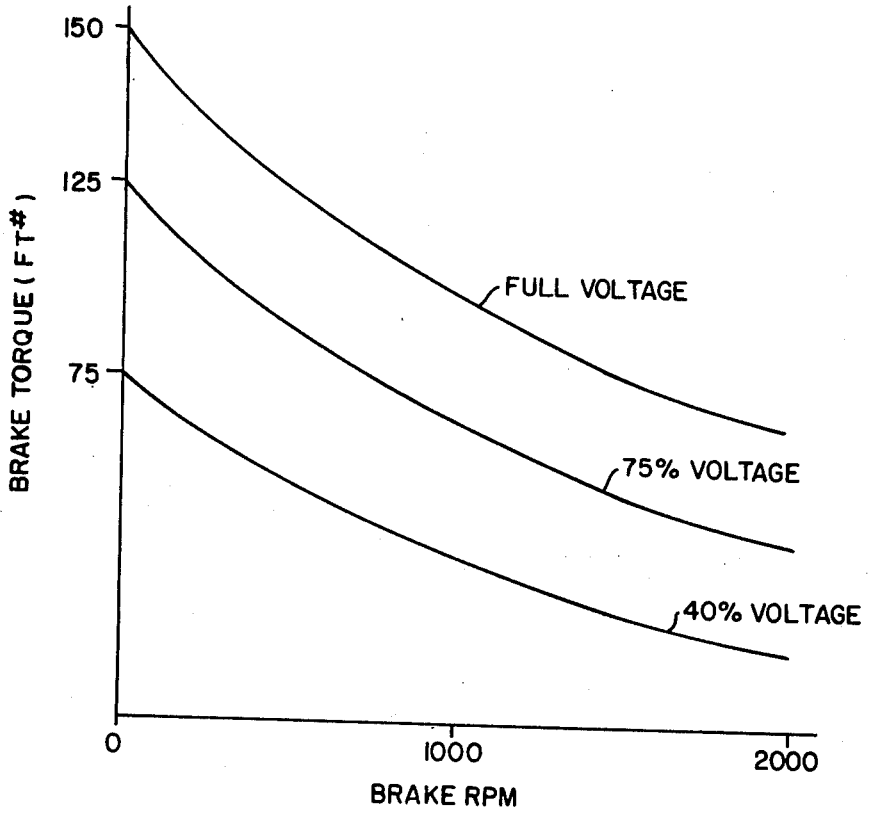
FIG. 2 is a graph which illustrates brake torque versus brake RPM characteristics at predetermined brake control voltages, of a controllable brake which may be used in the elevator system of FIG. 1.

More specifically, elevator system 10 includes an elevator car 12 and a counterweight 14 mounted for guided movement in the hoistway of a building having a plurality of floors, with four floors 1F, 2F, 3F and 4F, being illustrated for purposes of example. The elevator car 12 and counterweight 14 are connected to opposite ends of a wire rope or cable 16 which passes over a traction or a drive sheave 18. The drive sheave 18 is mounted on the output shaft 20 of a reduction gear 22 which is driven by a three-phase alternating current induction motor 24. The three-phase induction motor 24 is connected to a source of three-phase alternating current voltage via a circuit breaker or switch 26. Functionally, the induction motor required by the invention may be a single speed motor, but a two speed motor may be provided, if desired, in order to provide a lower speed for hand control. Also mounted on the shaft 20 is a brake drum 28. A brake 30 is urged against the brake drum 28 by a spring. A brake coil 32 adjustably overcomes the urging of the spring, dependent upon the magnitude of the voltage applied to the brake coil. A suitable adjustable brake which may be used is the Warner 650 Electro Brake, manufactured by Warner Electric Brake & Clutch Co., Beloit, Wisc., which has the torque versus RPM characteristics shown in FIG. 2 for full, 75 percent and 40 percent control voltages.

The supervisory control for the elevator system 10 includes a floor selector 32, which for purposes of example will be assumed to be of the notching type, such as described in U.S. Pat. No. 1,979.679, which is stepped or notched in response to indicators (not shown) disposed in the hoistway. These indicators may be cams for operating switches carried by the car, magnetic plates for operating inductor relays carried by the car, or permanent magnets for operating magnetically responsive switches, such as reed switches, carried by the elevator car. The switches, inductor relays or reed switches are mounted on the elevator car 12 in a suitable control panel. The indicators are disposed in different vertical lanes in the hoistway in order to actuate two notching switches alternately from floor-to-floor and thus prevent contact bounce from falsely notching the floor selector.

Slowdown of the elevator car is responsive to indicators disposed in the hoistway for each floor which may be approached when the car is traveling upwardly, such as indicators 34, 36 and 38 for floors 2F, 3F, and 4F, respectively, and for each floor which may be approached when the elevator car is traveling downwardly, such as indicators 40, 42 and 44 for floors 3F, 2F and 1F, respectively. These indicators may be the same as hereinbefore described for notching the floor selector, with the car mounted switches, indicator relays, or reed switches being mounted on the elevator car 12 in control panel shown generally at 46.

Car calls as registered by pushbutton array 48 disposed in the elevator car 12 are directed to the floor selector 32, as are hall calls which are registered by up and down pushbuttons mounted in the halls, such as up pushbutton 50 at the first floor 1F, down pushbutton 52 at the uppermost floor 4F, and up and down pushbuttons shown generally at 54 and 56 for floors 2F and 3F, respectively. If a car call or hall call is registered for a floor, the floor selector 32 provides control signals for various other control devices, as will be hereinafter described, when the slowdown indicator for the associated floor is reached.

When the elevator car 12 is to stop at a floor, the slowdown indicator for this floor and control 46 provide a signal for the floor selector 32, and floor selector 32 provides a signal which disconnects the electrical power from the alternating current drive motor 24, and simultaneously therewith signals from the floor selector initiate the controlled braking of the shaft 20 by providing signals which energize the closed loop regulating apparatus which controls the braking torque in response to the velocity of the car in the deceleration path, and in response to the displacement of the elevator car from the floor at which it is to stop, with respect to time.

More specifically, the control signal responsive to displacement of the elevator car from the floor at which it is to stop is provided by apparatus which includes: (a) a distance with respect to time pattern generator 60 which initiates the desired displacement pattern at the start of slowdown in response to a signal from the floor selector 32, (b) apparatus for providing a signal responsive to the actual location of the elevator car in the deceleration path, and (c) means for providing a first error signal E1 responsive to any difference. The actual car position may be measured by any suitable means. For example, at the start of slowdown a magnetic clutch may be actuated to couple a potentiometer to the shaft 20 which provides the desired output voltage profile. When the landing has been completed, the clutch would drop out and a spring return would reset the potentiometer for the next stop.

FIG. 1 illustrates a digital arrangement for measuring actual car position, which is a preferred arrangement because the car velocity may be determined from the same digital apparatus. Pulses responsive to car movement may be generated in any suitable manner, such as by a perforated tape-detector combination, or a rotary device-detector combination. In the FIG. 1 embodiment, a wheel 62 having a plurality of teeth 61 or openings therein is driven by the shaft 20, and a detector or pick up means 63 is disposed relative to the wheel 62 to detect the movement of the teeth 61 or openings as the wheel rotates. The pick up means 63 may be of any suitable type, magnetic or photoelectric, such as the photoelectric device shown in FIG. 1 which includes a source 64 of electromagnetic radiation directed towards and spaced from a detector 66 such that the discontinuities provided on the wheel 62 pass therebetween when the shaft 20 is rotating. The source 64, for example, may be a light emitting diode, a glow lamp, or a neon lamp, and the detector 66 may be a phototransistor, a photodiode, or a photoresistor. The pick up means may also be of the magnetic type, using proximity detector principles which requires a single coil, or the transformer principle which uses two coils.

The detector 66 includes means for generating electrical pulses as the discontinuities of the wheel 62 are detected. The output of the detector 66 is controlled by a switch 68 which is closed at the start of slowdown by a signal from the floor selector 32. When switch 68 is closed, a digital counter 70 counts the pulses, and the output of the counter 70 is applied to a digital-to-analog converter 72 to provide an analog signal responsive to the magnitude of the count. When the elevator car stops, the running relay (not shown) drops out, and a contact of the running relay resets the counter 70. The counter may start at a predetermined elevated count and count down, or it may start at zero and count up, depending upon whether the generated pattern from the pattern generator 60 increases or decreases with respect to time. For purposes of example, the pattern generator 60 is selected to provide an increasing signal, so the counter 70 will be reset to start its count at zero. The output voltage for the digital-to-analog converter is applied to a subtraction input of a summing circuit 74, the output of the distance versus time pattern generator 60 is applied to an addition input thereof, and the output provides an error signal El responsive to any difference in the magnitude of the two signals.

The deceleration control according to the invention utilizes a constant slowdown distance, referenced $D_0$, regardless of travel direction, and the time required to stop the elevator car at floor level from initial slowdown, referenced $T_0$, is also a constant. The slowdown time is selected by dividing the contract car velocity $V_O$, ie., the car speed at the start of slowdown, by the maximum desired deceleration rate. If the contract speed is 200 FPM and the desired deceleration rate is 3 ft/sec², then the time to land, $T_O$, will be 200/(60×3), or 1.11 seconds.

Since the deceleration distance and deceleration time are constant values, the only variable is car speed or velocity, which variable will be controlled according to the invention by controlling the deceleration torque applied to slowdown the rotation of the drive sheave.

The desired location of the elevator car in the deceleration path with respect to time is indicated by the formula:

$$d = -\tfrac{1}{2}\,at^2 + V_O t \text{ where:}$$

Figure 3:
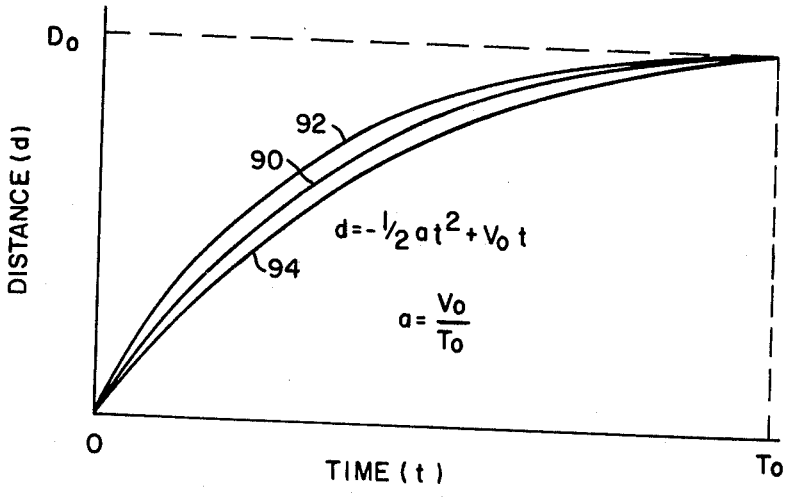
FIG. 3 is a graph which illustrates different predetermined patterns of the desired distance of the elevator car from the floor level at which it is to land with respect time, using different initial car speeds with a fixed time to land, and a fixed length of the deceleration path.

$d$ = the distance of the elevator car from the slowdown point at any selected point in time during slowdown $a$ = the deceleration rate $t$ = the time starting at slowdown at which the desired car location is to be calculated $V_O$ = initial car velocity FIG. 3 is a graph which plots distance moved by the elevator car from the slowdown point versus time, for different initial velocities, but with the same time to land $T_O$. Curve 90 represents the pattern profile for an initial velocity $V_O$, curve 92 represents the pattern profile for a higher initial velocity $V_0''$, and curve 94 represents the pattern profile for a lower initial velocity $V_O'$.

A pattern generator 60 which provides a voltage according to this formula may be provided by applying a source 80 of constant unidirectional potential to an RC circuit 82. The initial charging waveform of an RC circuit is substantially linear, and a potentiometer may be included to allow the circuit to be adjusted to provide the correct charging rate corresponding to the portion of the formula representing $V_O t$. *The output of RC circuit 82 may be integrated to provide the portion of the formula representing* $\tfrac{1}{2}\,at^2$, or, as illustrated, the constant undirectional voltage source 80 may be applied to a separate RC circuit and integrating circuit 84. The output of RC circuit 82 is applied to an addition input of a summing circuit 86 and the output of the integrator circuit 84 is connected to a subtraction input of summing circuit 86. The output of summing circuit 86 thus provides a pattern voltage representing the desired position of the elevator car in the deceleration path with respect to time. As hereinbefore stated, this output, which is representative of the formula:

$$d(t) = \tfrac{1}{2}\,at^2 + V_O t$$

is applied to the summing circuit 74, and if the actual position of the elevator car does not correspond to the desired position, an error signal E1 will be provided with a polarity which indicates which signal applied to the inputs of the summing circuit has a larger magnitude. If the pattern signal exceeds the magnitude of the actual car position signal the braking torque must be increased, and the polarity of the error signal E1 will be positive. If the pattern signal is less than the magnitude of the actual car position signal, the braking torque must be decreased and the polarity of the error signal E1 will be negative.

The control signal responsive to the velocity of the elevator car with respect to time, starting at slowdown, is provided by apparatus which includes: (a) a velocity versus time pattern generator 110, which initiates the desired velocity pattern at the start of slowdown in response to a signal from the floor selector 32, (b) apparatus for providing a signal responsive to the actual velocity of the elevator car, and (c) means for providing an error signal E2 responsive to any difference. The actual car velocity may be measured by any suitable means, such as by a tachometer. FIG. 1 illustrates a preferred digital arrangement for obtaining such indication from the pulses produced by the detector 66.

More specifically, when switch 68 is closed, the pulses from detector 66 are applied to a monostable multivibrator 112. The output of the multivibrator 112 is a series of constant width pulses spaced according to the rate at which pulses are received from the detector 66. These pulses from the multivibrator 112 are used to gate a switch 114, which has one side connected to a positive source 116 of unidirectional potential via resistor 118, and the other side of the switch is connected to ground 120. Switch 114 may be an NPN transistor, for example, with the output of the multivibrator 112 connected to the base, the collector connected to resistor 118 at junction 122, and the emitter connected to ground 120. A low pass filter amplifier 130 is connected to junction 122. Filter amplifier 130 may include an operational amplifier 131 having its inverting input connected to junction 122 via a resistor 132. Its non-inverting input is connected to a source 34 of positive unidirectional potential via an adjustable resistor 136. A capacitor 138 and a resistor 140 are connected in parallel between the inverting input at junction 142 and the output of the operational amplifier at junction 144, to provide the feedback loop for the operational amplifier.

In the absence of a pulse from the multivibrator 112, switch 114 is open and the positive source 116 is connected to the inverting input of filter amplifier 130. When a pulse is received from the multivibrator 112, switch 114 closes to connect the inverting input of filter amplifier 130 to ground. Thus, the output of the low pass filter amplifier provides a unidirectional output voltage having a magnitude responsive to car speed, as the pulse rate determines the relative time the switch 114 is connected to ground. As the car slows down the relative time the switch is connected to ground decreases, the effective input voltage is more positive and the output voltage of the filter becomes less positive, i.e., its magnitude is decreasing. The output of the low pass filter 130 is applied to a subtraction input a summing circuit 150, and an addition input is connected to the output of the velocity versus time pattern generator 110.

Figure 4:
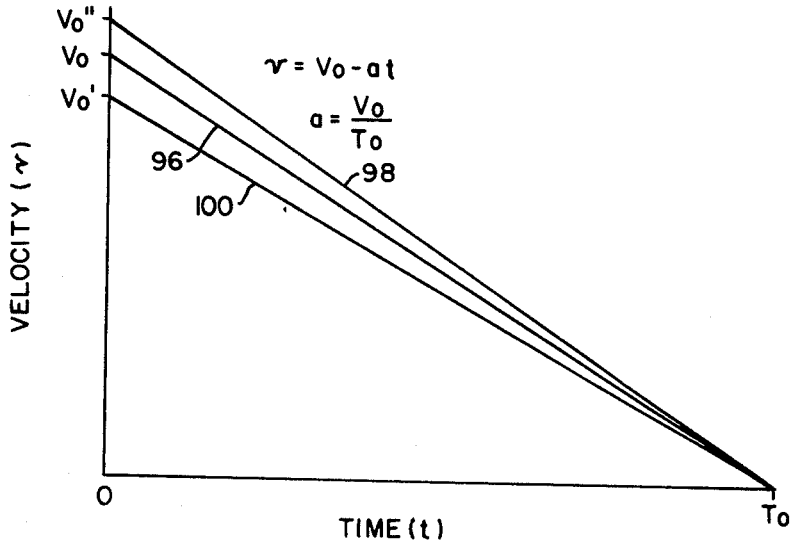
FIG. 4 is a graph which illustrates different speed patterns of the desired velocity of the elevator car with respect to time, using a fixed time to land.

The desired velocity of the elevator car with respect to time, during deceleration, is indicated by the formula:

$$v = V_0 - at$$

where:

$v$ = the velocity of the elevator car at any selected point in time during slowdown $V_0$ = the initial car velocity $a$ = the deceleration rate $t$ = the time starting at slowdown at which the desired car velocity is to be calculated FIG. 4 is a graph which plots car velocity versus time, starting at slowdown, for different initial velocities $V_0$, $V_0''$, and $V_0'$. Curve 96 represents the pattern profile for an initial velocity $V_0$, curve 98 represents the pattern profile for a higher initial car velocity $V_0''$, and curve 100 represents the pattern profile for a lower initial velocity $V_0'$.

A pattern generator 110 which provides a voltage according to this formula may be provided by applying a source 152 of constant unidirectional potential to an RC circuit 154, which may include a potentiometer for adjustment to provide a linear charging voltage waveform which represents $V_0t$. The output of the RC circuit 154 is applied to a subtraction input of a summing circuit 156. The constant voltage source 152 is directly applied to an addition input of a summing circuit 156, representing the term $V_0$ of the formula, and the output which represents $V_0-at$, is applied to an addition input of summing circuit 150. If the actual velocity of the elevator car with respect to time during slowdown differs from the desired velocity of the elevator car, an error signal E2 will be provided with a polarity to indicate which input signal of the summing circuit is larger. If the pattern signal exceeds the magnitude of the signal representing actual car velocity, the velocity is too high, the braking torque must be increased, and the polarity of the error signal E1 will be positive. If the pattern signal is less than the magnitude of the actual car velocity, the braking torque must be decreased and the polarity of the error signal E2 will be negative.

Figure 5:
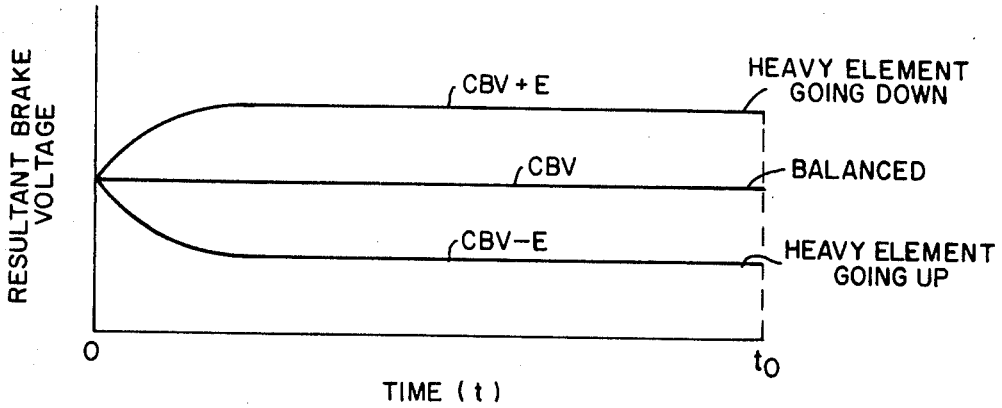
FIG. 5 is a graph which symbolically illustrates the brake voltage applied to the controlled brake, and the source of the brake voltage for balanced and unbalanced elevator conditions.

The error signals E1 and E2 may be used to provide the complete braking voltage by combining them in a summing circuit. However, the new and improved control system has been found to provide even more accurate landings when the error signals E1 and E2 add to or subtract from a source 160 of constant voltage CBV. Further, tests indicate that the most accurate landings are achieved, i.e., ±0.25 inch with an initial velocity of 200 FPM, when the value of the constant braking voltage CBV is selected to be that voltage which will accurately stop the elevator car at the desired floor level without any error signal modification thereof, when the weight of the elevator car and its load exactly balances the weight of the counterweight. The counterweight is normally selected to exactly counterbalance the elevator car when the car load is 40 percent of its rated capacity. Thus, when the car load is 40 percent of rated capacity, the constant braking voltage CBV will stop the elevator car at floor level and its value will not be increased or decreased by the error signals during slowdown. FIG. 5 is a graph which illustrates the action of the error signals on the constant braking voltage CBV. When the system is balanced, the resultant braking voltage will be equal to CBV. When the system is unbalanced and the heavier element is going down, more braking torque will be required and the error signals, on average, will add to the constant braking voltage CBV. When the system is unbalanced and the heavier element is going up, less braking torque will be required and the error signals, on average, will subtract from the constant braking voltage CBV.

The resultant braking voltage may be provided by connecting the error signals E1 and E2 and the constant braking voltage CBV to a three addition input summing network 162, and the output of the summing network 162 is applied to the brake coil 32 via an amplifier 164 and a switch 166. The switch 166 is responsive to the floor selector 32, closing at the start of slowdown to actuate the controlled braking of the elevator system. Removal of the constant braking voltage CBV from the summing network 162 will automatically cause the error signals E1 and E2 to provide the complete control signal for amplifier 164.

In summary, there has been disclosed a new and improved elevator system of the traction type which provides a controlled deceleration of an elevator car which is smooth, and which provides repeatable high accuracy landings. The new and improved elevator system is especially suitable for geared elevator systems in which the drive motor is a three-phase induction motor, and with the controllable element being a friction brake which may be controlled by an error signal to provide the required deceleration torque. The error signal for controlling the friction brake is the resultant of two independently controlled feedback loops, with the first feedback loop providing an error signal responsive to the deviation of the actual car velocity from the desired car velocity with respect to time, and the second error signal is responsive to any deviation of the actual location of the elevator car in the slowdown path, with respect to the desired position of the elevator car with respect to time. In a preferred embodiment, the error signals operate on a constant braking voltage, with the constant braking voltage being selected to stop the elevator car at a selected floor level without error signal modification, when the elevator car and its load exactly balances the weight of the counterweight.

We claim as our invention:

1. An elevator system, comprising:

a structure having a plurality of floors, an elevator car, motive means for moving said elevator car in said structure to serve the floors, deceleration control means providing an adjustable braking torque to stop said elevator car at a selected floor, first feedback means providing a first feedback signal responsive to the position of the elevator car relative to a fixed deceleration path when the elevator car is to stop at a floor, first pattern signal means providing a first pattern signal responsive to the desired position of the elevator car in the deceleration path with respect to time, first error signal means providing a first error signal responsive to any difference between said first feedback signal and said first pattern signal, second feedback means providing a second feedback signal responsive to the speed of the elevator car in the deceleration path, second pattern means providing a second pattern signal responsive to the desired speed of the elevator car in the deceleration path with respect to a fixed time for the elevator car to traverse the deceleration path, and second error signal means providing a second error signal responsive to any difference between said second feedback signal and said second pattern signal, said deceleration control means providing a braking torque for said elevator car responsive to said first and second error signals.

2. The elevator system of claim 1 including means providing a braking signal of fixed magnitude for said deceleration conrol means, with the first and second error signals modifying the braking signal, and wherein the braking torque provided by the deceleration means is responsive to the modified braking signal.

3. The elevator system of claim 2 including a counterweight connected to the elevator car, and wherein the magnitude of the braking signal is selected such that it will stop the elevator car at a selected floor without modification by the error signals when the counterweight balances the elevator car and its load.

4. The elevator system of claim 1 wherein the motive means includes a three-phase induction motor and the deceleration control means is a controllable friction brake.

5. The elevator system of claim 1 wherein the motive means includes a three-phase induction motor and reduction gear, and the deceleration control means is a controllable friction brake.

6. The elevator system of claim 1 including means for generating digital signals responsive to the speed of the elevator car, with the second feedback means being responsive to the rate the digital signals are produced and with the first feedback means being responsive to the number of digital signals produced.

7. The elevator system of claim 1 wherein the motive means includes a three-phase induction motor and the deceleration control means is an electrically controlled friction brake, and including means for terminating the torque provided by the induction motor and for energizing the friction brake when the distance representing the fixed deceleration path is reached for a floor at which the elevator car is to stop.

8. The elevator system of claim 7 including means for generating digital signals responsive to the speed of the elevator car, with the second feedback means being responsive to the rate the digital signals are produced, and the first feedback means being responsive to the number of digital signals produced starting at the start of the fixed deceleration path.

* * * * *